United States Patent [19]

Curtis et al.

[11] Patent Number: 4,706,815

[45] Date of Patent: Nov. 17, 1987

[54] DISPENSING CONTAINER FOR TRIPHASIC

[75] Inventors: H. Edward Curtis, Perkasie; Thomas J. Gaffney, West Chester, both of Pa.

[73] Assignee: American Home Products Corporation, New York, N.Y.

[21] Appl. No.: 410,757

[22] Filed: Aug. 23, 1982

[51] Int. Cl.[4] ..... B65D 83/04

[52] U.S. Cl. ..... 206/531; 206/533; 206/534; 116/308

[58] Field of Search ..... 206/531–534; 116/308; 221/4, 5, 86, 87

[56] References Cited

U.S. PATENT DOCUMENTS

| | | | |
|---|---|---|---|
| D. 257,106 | 9/1980 | Johnson | D7/1 |
| 3,143,207 | 8/1964 | Wagner | 206/533 |
| 3,199,489 | 8/1965 | Ruoss et al. | 116/308 |
| 3,276,573 | 10/1966 | Kaufman et al. | 206/531 |
| 3,437,236 | 4/1969 | Huck | 221/86 |
| 3,651,927 | 3/1972 | Richardson et al. | 206/531 |
| 3,942,641 | 3/1976 | Segre | 206/534 |
| 4,165,709 | 8/1979 | Studer | 116/308 |
| 4,292,315 | 9/1981 | Vorys | 206/533 |

FOREIGN PATENT DOCUMENTS

| | | | |
|---|---|---|---|
| 467064 | 2/1969 | Switzerland | 206/534 |

*Primary Examiner*—Stephen Marcus
*Assistant Examiner*—Brenda J. Ehrhardt
*Attorney, Agent, or Firm*—Joseph M. Weigman

[57] ABSTRACT

A dispenser for solid dosage form pharmaceutical preparations for self-administration on a daily basis related to the menstrual cycle is made up of a blister pack in a carrying case. The case has a septagonal post and the blister pack a cooperating septagonal opening. The dose form to be taken on the first day is indicated and is aligned with the day taken. The remaining dose forms are taken sequentially. Once inserted on the starting day, the blister pack is not moved. A triphasic, 21-day regimen for oral contraceptives is described which may be followed by seven days of iron tablets.

9 Claims, 6 Drawing Figures

FIG. 1
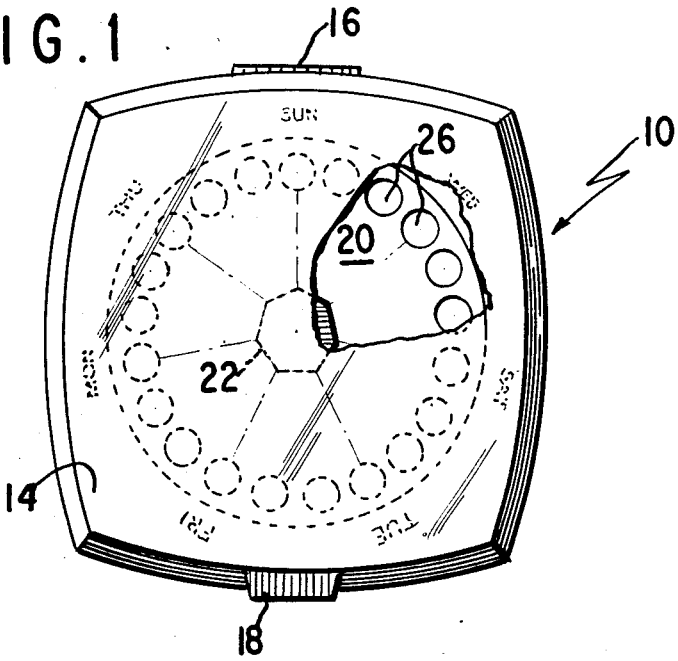
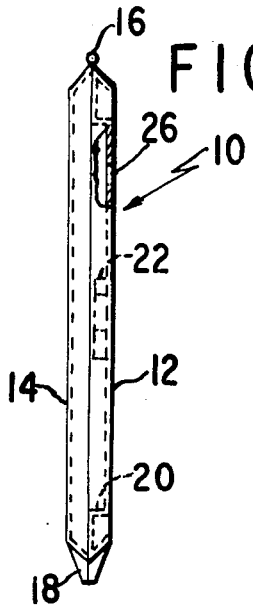
FIG. 2
FIG. 4
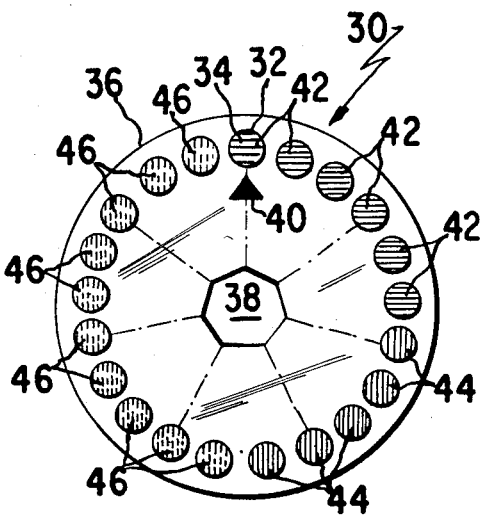
FIG. 3
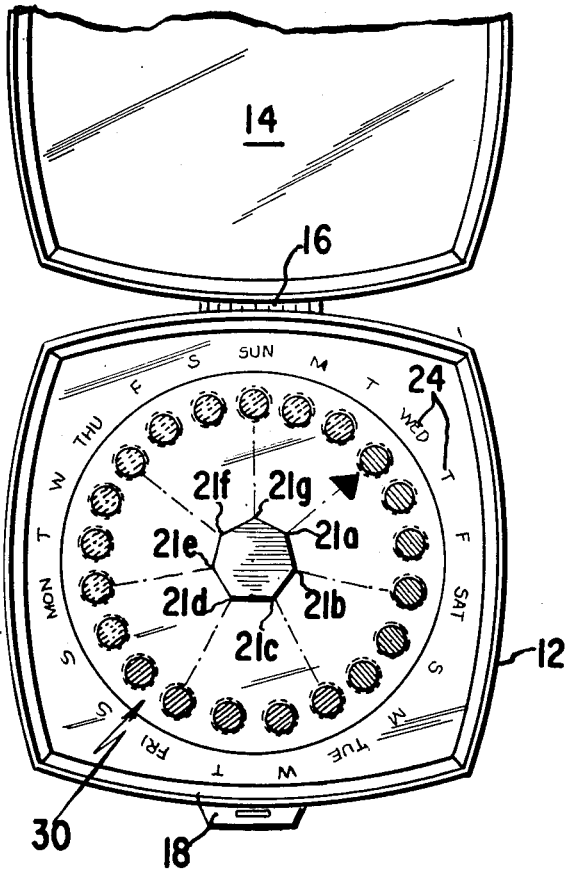

DISPENSING CONTAINER FOR TRIPHASIC

This invention relates to a pharmaceutical dispensing container in which a regimen of treatment is contained in dose forms, which are contained in a blister pack that is held in a compact carrying case. The present dispensing container is intended principally for use with a triphasic contraceptive regimen. That is, three different compositions are used to mimic as closely as possible the characteristic fluctuations in the plasma levels of β-oestradiol and progesterone.

Much research has been conducted in the time since the contraceptive pill was first introduced towards improving the patient tolerance and cycle control of the preparations, and to increase their safety from a medical point of view by reducing the effect on certain parameters of the hemostatic system and metabolic functions. Improvements have been achieved by reducing the dose size and by changing the oesterogen:progestagen ratio in the dose form. It is known that during the normal menstrual cycle, there are plasma levels of β-oestradiol and progesterone that fluctuate in characteristic fashion. For a time, the estrogen content of the oral contraceptive was considered to be a problem portion and reduction in its amount was an early goal. Later, however, the role of progesterone was determined to be beneficial and dose forms and regimens of treatment were prepared to reflect this advantage. In the last ten years, attempts have been made to develop a step-up preparation containing the lowest possible quantities of both hormone components. From this evolved three-phase regimens of treatment which would provide increased estrogen doses for five days in mid-cycle, which fits in with the normal pre-ovulatory estrogen peak. As in the normal cycle, the follicular phase is sub-divided into a post menstrual phase of six days' duration, and a peri-ovulatory one of five days' duration which retains the ten-day luteal phase which proved so successful in the biphasic regimen.

It is an object of the present invention to provide a pharmaceutical dispensing container for use in a three-phase oral contraceptive regimen of treatment.

It is a further object of the present invention to provide a novel dispensing package which may be used with both a twenty-one or a twenty-eight-day regimen of treatment.

Other and further objects of the invention will be apparent to those skilled in the art from reading the following description in conjunction with the drawings in which:

FIG. 1 is a top view of a preferred embodiment of the compact carrying case shown in the closed position and partly cut away;

FIG. 2 is a side view of the container of FIG. 1;

FIG. 3 is a plan view of the blister pack used in conjunction with the carrying case of FIG. 1;

FIG. 4 is a top view, partly cut away, of the pharmaceutical dispensing container in the open position showing the blister pack of FIG. 3 in place in the carrying case of FIG. 1;

Figure 5:
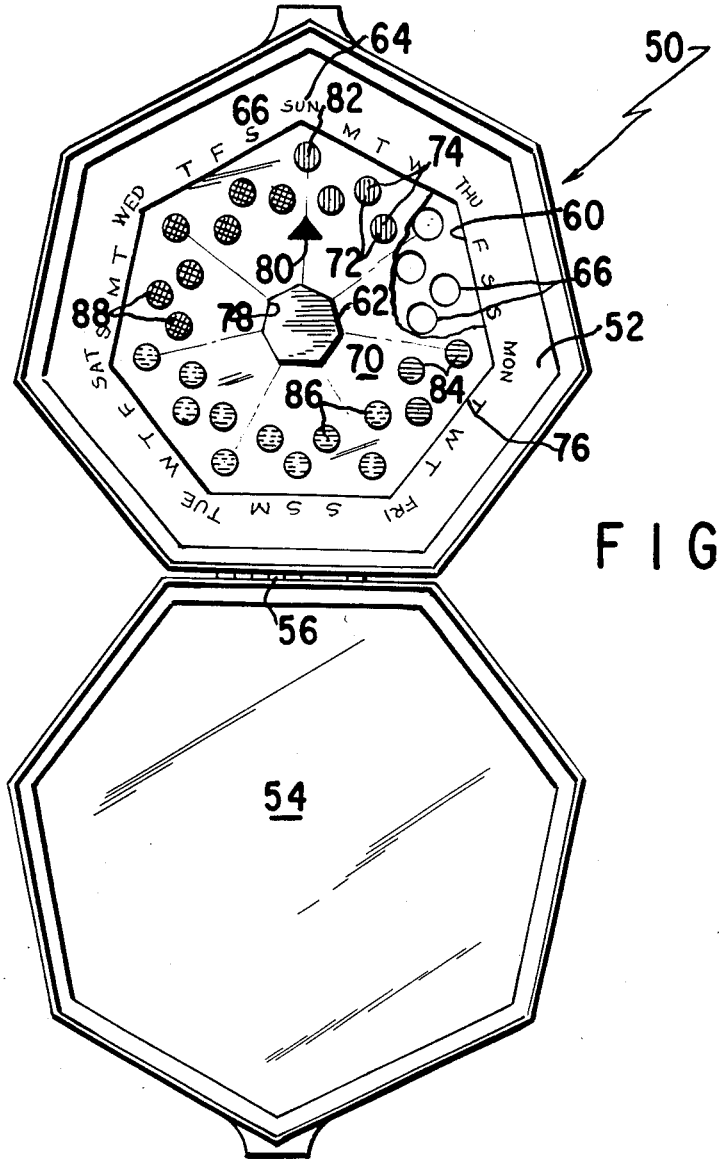
FIG. 5 is a top view of an alternate embodiment of a pharmaceutical dispensing container shown in the open position with a blister pack in place.

The pharmaceutical dispensing container 10, as seen in FIGS. 1–4, is made up of a base 12 and a cover 14 connected by a hinge 16 and having a clasp means 18.

The base 12 has a recess 20 formed in it of predetermined shape to receive a blister pack. In the center of the recess 20 is a septagonal post 22. Around the periphery of the recess 20 are indicia 24 for the days of the week. A plurality of dispensing orifices 26 are formed through the recess 20 of the base in a pattern corresponding to the pattern of the dose forms in the blister pack, and through which the dose forms may be dispensed from the blister pack in well-known fashion.

The blister pack 30 is formed, as is well known in the art, from a clear, flexible material having a plurality of blisters, or small chambers 32, to receive dose forms 34 and, in well-known fashion, is closed with a facing strip or backing strip, not shown, made of a rupturable foil or plastic material. As is shown in FIG. 3, the blister pack 30 has a substantially circular periphery 36 and a septagonal opening 38 formed in its center and adapted to fit over the septagonal post 22 of the base 12. The chambers 32 are arranged in a circle. An indicia 40 is marked on the face of the blister pack to indicate the first dose form to be dispensed in a regimen of treatment.

As is shown in FIG. 3, in the preferred embodiment, the blister pack contains twenty-one dose forms, preferably tablets. There are six tablets 42 of a first composition, sequentially followed by five tablets 44 of a second composition, and by ten tablets 46 of a third composition. On the day of onset of menses, the user inserts the blister pack 30 into the base 12 so that the starting indicia 40 is oriented with the day of the week, for instance, Wednesday, as shown in FIG. 4. The regimen of treatment is such that successive pills are taken on successive days, each of which is marked with the indicia for the day of the week it is to be taken. Once inserted on the starting day, the blister pack is not moved. The shape of the post prevents rotation of the blister pack.

In the preferred embodiment, an indicia for a different day of the week is formed in bold characters and is associated with a different apex (21*a* through 21*g*) of the sides of the septagonal post 22. The intermediate days follow in order. It is to be noted that the successive apices are not oriented with successive days of the week, there being three tablets between successive apices and seven days in the week.

Figure 6:
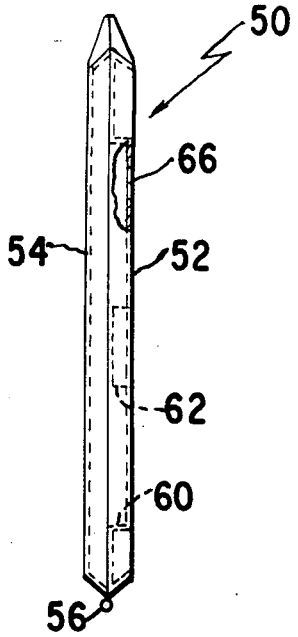
FIG. 6 is a side view of the container of FIG. 5.

In the alternate embodiment shown in FIGS. 5 and 6, the pharmaceutical dispensing container 50 is made up of a base 52 and a cover 54 joined by a hinge 56. A recess 60 is provided in the base and corresponds to the shape of a blister pack 70. A septagonal post 62 is formed at the center of the recess 60 and indicia 64 are provided on the base adjacent to the recess corresponding to the days of the week. Dispensing orifices 66, as shown in the cut-away portion, are provided and arranged in the same pattern as the dose forms of the blister pack 70.

The blister pack 70 in the embodiment shown has twenty-eight blisters, or chambers 72, containing four different dose forms 74. The dose forms are preferably tablets, although capsules and other dose forms may be used.

In the embodiment of FIG. 5, the periphery 76 of the blister pack is septagonal and corresponds to the septagonal shape of the recess 60, and the septagonal opening 78 cooperates with the septagonal post 62. The blisters 72 are arranged in straight lines and staggered as shown. An indicia 80 indicates the dose form to be taken on the first day of the regimen of treatment.

In the twenty-eight-day regimen for which the container 50 may be used, the dose forms 82 are six tablets of a first composition followed sequentially by five tablets 84 of a second composition, and ten tablets 86 of a third composition and seven iron tablets 88. Preferably, the dose forms are colored, the colors being different for each composition and for the iron tablets. The tablets of the compositions are disposed in the blisters so that all tablets of the first composition will be taken before those of the second composition are started and those of the second composition will be completed before those of the third composition are started. The iron tablets, when present, are started after the third composition.

The principal regimens of triphasic treatment make use of the tablets of the following compositions, regimen A being PREFERRED:

REGIMEN A

First Composition:

6 coated tablets of 30 mcg ethinylestradiol and 50 mcg levonorgestrel

Second Composition:

5 coated tablets of 40 mcg ethinylestradiol and 75 mcg levonorgestrel

Third Composition:

10 coated tablets of 30 mcg ethinylestradiol and 125 mcg levonorgestrel

REGIMEN B

First Composition:

6 coated tablets of 0.03 mg ethinylestradiol and 0.05 mg levonorgestrel

Second Composition:

5 coated tablets of 0.05 mg ethinylestradiol and 0.05 mg levonorgestrel

Third Composition:

10 coated tablets of 0.04 mg ethinylestradiol and 0.125 mg levonorgestrel

Equivalent means may be substituted for those described above. For instance, the shape of the container and of the base and blister pack may be varied. The sides of the septagonal post may be arcuate rather than straight, and the sides of the septagonal opening in the blister pack may be made accordingly. Also, the cover may be eliminated and the blister pack retained within the base by other means, such as lugs or projections formed in the base.

What is claimed is:

1. A pharmaceutical dispensing container comprising two elements:

A. a blister pack of predetermined shape containing a plurality of dose forms in blisters in multiples of seven arranged in sequential order of use circumferentially adjacent the edge of said blister pack;

1. a septagonal opening in the center of said blister pack; and

B. a compact carrying case having 1. a base having a plurality of openings arranged in the same pattern as said dose forms in said blister pack;
2. a recessed area adapted to receive said blister pack;
3. a septagonal post in the center of said recess adapted to engage said septagonal opening of said blister pack;
4. indicia of the days of the week marked on said base adjacent the periphery of said recess, whereby each indicium is adjacent one of said dose forms of said blister pack; and
5. means to retain said blister pack in said case.

2. A pharmaceutical dispensing container, as defined in claim 1, further comprising dose forms of at least three different compositions contained in said blisters in predetermined order, and indicia formed on said blister pack for orienting the first dose form to be taken with an indicium of the day of the week on said base.

3. A pharmaceutical dispensing container, as defined in claim 2, wherein twenty-one dose forms are arranged sequentially with six dose forms of a first composition, five dose forms of a second composition and ten dose forms of a third composition.

4. A pharmaceutical dispensing container, as defined in claim 2, wherein twenty-eight dose forms are arranged sequentially with six dose forms of a first composition, five dose forms of a second composition, ten dose forms of a third composition and seven dose forms of a fourth composition.

5. A pharmaceutical dispensing container as defined in claim 1 wherein said means to retain said blister pack is a cover hingedly connected to said base.

6. A pharmaceutical dispensing container as defined in claim 1 wherein said blister pack is round.

7. A pharmaceutical dispensing container as defined in claim 1 wherein said blister pack is septagonal.

8. A pharmaceutical dispensing container as defined in claim 2 wherein said starting indicium on said blister pack is oriented with an apex of said septagonal opening.

9. A pharmaceutical dispensing container as defined in claim 1 wherein the indicia on said base are oriented such that a different day of the week is associated with each apex of said septagonal post.

* * * * *